United States Patent [19]

Bonnar

[11] 4,189,692

[45] Feb. 19, 1980

[54] LOCK CONTROLLED POWER SHUT-OFF SYSTEM

[76] Inventor: John H. Bonnar, 1630 Calle Vaguero #302, Glendale, Calif. 91206

[21] Appl. No.: 879,812

[22] Filed: Feb. 21, 1978

[51] Int. Cl.[2] ..... H01H 3/14

[52] U.S. Cl. ..... 335/205; 200/61.67

[58] Field of Search ..... 200/61.67, 61.68; 70/49; 335/205, 207, 206; 340/542, 547

[56] References Cited

U.S. PATENT DOCUMENTS

| | | | |
|---|---|---|---|
| 1,724,930 | 8/1929 | Hart | 200/61.67 |
| 2,756,300 | 7/1956 | Thiberville | 200/61.67 |
| 3,803,575 | 4/1974 | Gotanda | 340/542 |
| 3,810,145 | 5/1974 | Gusaras | 200/61.67 |
| 4,058,740 | 11/1977 | Dalton et al. | 307/116 |

*Primary Examiner*—Harold Broome

*Attorney, Agent, or Firm*—Christie, Parker & Hale

[57] ABSTRACT

A lock controlled power shut-off system provides for conserving power that would otherwise be wasted in an apartment building or the like by operating air conditioners or like power consuming equipment while the occupants are temporarily out of the building. The system includes a lock mechanism for a door or like access closure, and a sensor that causes the power consuming equipment to be disabled unless an occupant inside the building locks the lock mechanism. According to an advantageous feature, a person outside the building cannot lock the lock mechanism but can unlock it so that access can be gained into the building in an emergency.

5 Claims, 5 Drawing Figures

3
1
9
40
41
42
7
13
35
47
45
11
51
49
37
31
33
5
AIR CONDITIONING
CONTROL CIRCUIT 36

LOCK CONTROLLED POWER SHUT-OFF SYSTEM

BACKGROUND

This invention relates to a power conservation system.

In many buildings, such as hotels, motels, apartment buildings and similar buidlings, there is only a single utility meter, and the owner of the building incurs the cost of operating power consuming equipment such as air conditioners serving various units or rooms within the building. Many apartment dwellers or motel guests like to leave the air conditioning on while they are out of the building so that it will be cool immediately when they return. This is of course particularly the case when they personally do not directly pay for utility service.

In view of the foregoing, and for related reasons, it will be appreciated that there is a need for a system to reduce the waste of power resulting from the operation of air conditioners and the like in unoccupied rooms. This need has been a longstanding one, and has led others to propose various types of power conservation systems.

One prior art approach, which has been employed in motels, involves the distribution to motel guests of a special key. When the motel guest checks into the motel, he is given a key which he can use not only to get into the room but also operate a lock that controls the room air conditioner. When the guest checks out, he returns the key, and thus the air conditioner cannot be operated in the room during the periods between rentals. This type of system clearly has drawbacks with respect to use in the environment of an apartment building where generally there are several occupants in each apartment, each of whom has his own key.

The patent literature in this art also shows that others have proposed approaches to this problem. In this connection, reference is made to the following representative prior art patents: U.S. Pat. Nos. 2,756,300—Thiberville; 3,729,735—Dageford; 1,724,930—Hart.

Hart teaches an arrangement whereby the lights of a room in a motel are, in the event that they have been left on, automatically thrown off when the guest closes the door and locks it from the outside. With this approach, the lights remain on and power is wasted whenever the guest forgets to or elects not to lock the door from the outside.

Dageford teaches a remote sending device to control an air conditioning system upon the opening or closing of a window. His device involves an ultrasonic transmitter employing a tuning fork and accordingly entails considerable expense and complexity.

Thiberville teaches a lock controlled switch, and incidentally mentions the possibility of controlling the operation of an air conditioner with his switch. From his description of this matter at column 3, line 55 through column 4, line 9, it appears that his system involves the same kind of approach taken by Hart in that locking from the outside is required to turn off the power consuming equipment.

SUMMARY OF THE INVENTION

This invention provides a practical, economical system for reducing wasted power consumption, and embodies a unique arrangement that inherently overcomes drawbacks of prior art systems described above that rely upon occupants to voluntarily take affirmative steps directed to causing power shut off.

A system according to this invention is used in a building such as an apartment building having an openable closure such as a door through which access into and out of the building can be gained with the closure open.

The system comprises lock means adapted to be installed in the closure. The lock means includes a movable member such as a deadbolt that is movable in another direction to an unlocking position. The lock means further includes engaging means such as a recess into which the movable member fits while in the locking position with the closure closed.

The system further comprises sensing means responsive to the movable member being out of its locking position for disabling the power consuming equipment. Preferably, the sensing means includes a magnetically controlled switch that is concealed behind a partition defining a wall of the recess. When the movable member occupies the locking position, it cooperates with the magnetically controlled switch to enable the power consuming equipment to operate. The concealment feature is particularly advantageous in systems installed in doors of an apartment building having a single utility meter. With the switch not being visible, the apartment dwellers will not be prompted to devise gadgets to thwart the automatic power turn-off operation of the system.

In contrast to prior art approaches described above, a system according to this invention comprises manually controllable means, accessible only from the inside of the building while the closure is closed, for shifting the movable member in either direction between its locking and unlocking positions. Thus, when an occupant desires to exit the building while the power consuming equipment is on, the very step of unlocking the closure results in turning off the power even before the closure is opened. After the occupant leaves the building, he no longer has access to the manually controlled means and accordingly he can not shift it back to its locking position so as to cause equipment such as an air conditioner to operate until his return.

In accordance with a particularly advantageous and distinguishing feature, the preferred embodiment includes additional manually controlled means that is accessible from the outside of the building. This additional manually controlled means provides for shifting the movable member only from its locking position to its unlocking position. One advantage of this feature involves the gaining of access into the building in emergency circumstances. Other advantageous and important features are further set forth below.

DETAILED DESCRIPTION

Figure 1:
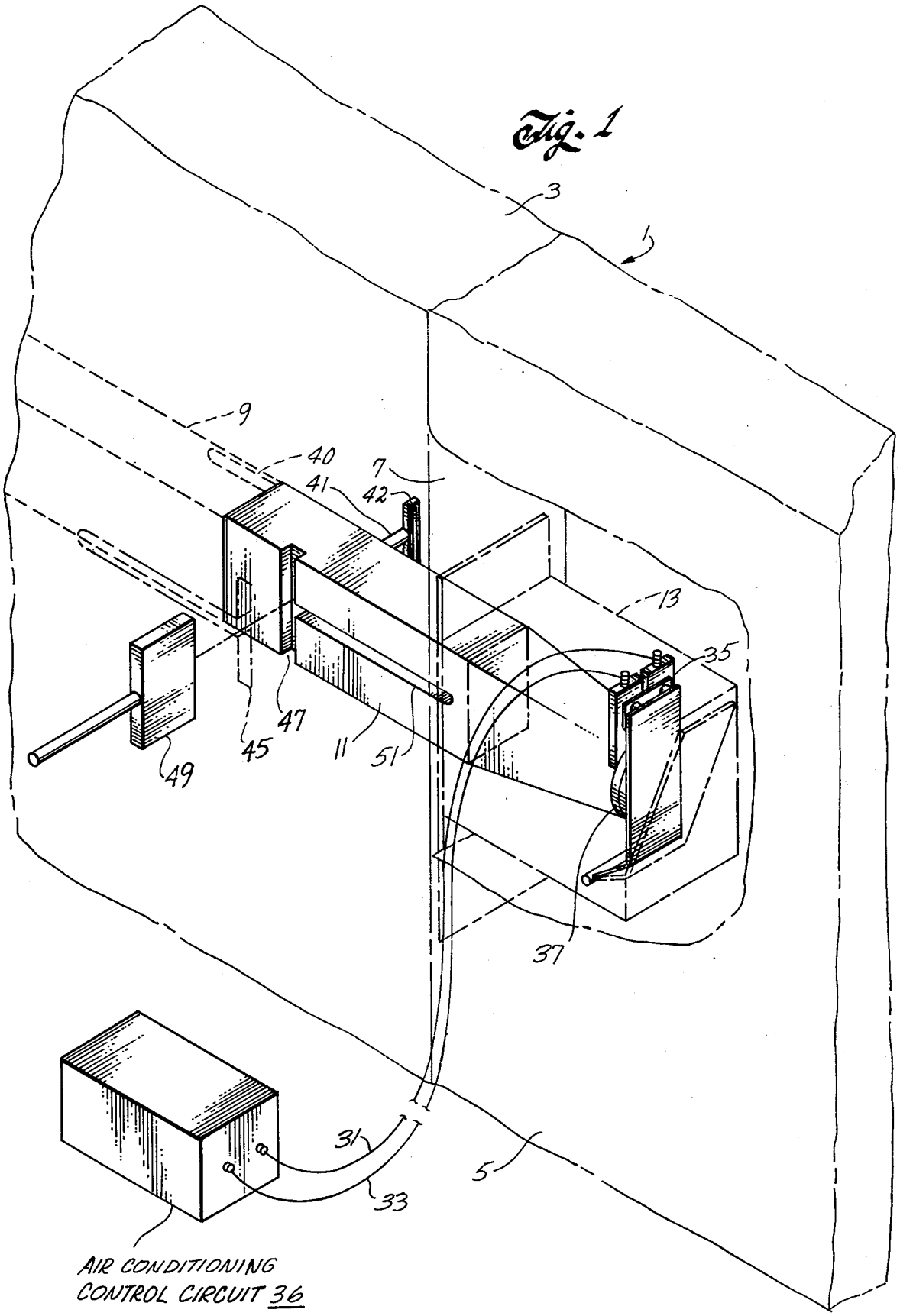
FIG. 1 is a perspective view schematically showing a portion of a closure of a building, viewed from its outside, in which the presently preferred embodiment of the invention is installed.

With reference to FIG. 1, a portion of a building access generally indicated at 1 includes a door panel 3 shown closed so that door panel 3 is aligned with a building wall 5. Door panel 3 is mounted by hinges (not shown) so that its free end 7 can swing away from the building.

A horizontally extending blind bore 9 extends into door panel 3 from free end 7. A deadbolt 11 defines a movable member within bore 9. Deadbolt 11 is movable to the left (as viewed from the outside) to an unlocking position at which deadbolt 11 is completely contained within bore 9, and is movable to the right to a locking position at which a portion of deadbolt 11 projects out of bore 9.

A horizontally extending stepped blind bore 13 extends into wall 5. Bore 13 is defined at the same height as bore 9. An assembly separately shown in FIG. 2 and generally indicated by 15 is installed in bore 13.

Assembly 15 includes a mounting plate 17 having an opening 19 through which deadbolt 11 can be moved into and out of assembly 15. When deadbolt 11 passes through opening 19 toward a locking position, it enters a recess defined by a generally tubular portion 21 of assembly 15. A partition 23 is provided so that other portions of assembly 15 are concealed from view. A member 25 depends from tubular portion 21, and a plate 27 is hinged to member 25. Owing to the effect of gravity, a torque is naturally imposed on plate 27 in the clockwise direction. In the absence of a counterbalancing torque, plate 27 will, with assembly 15 installed, lean against the end of bore 13.

Figure 2:
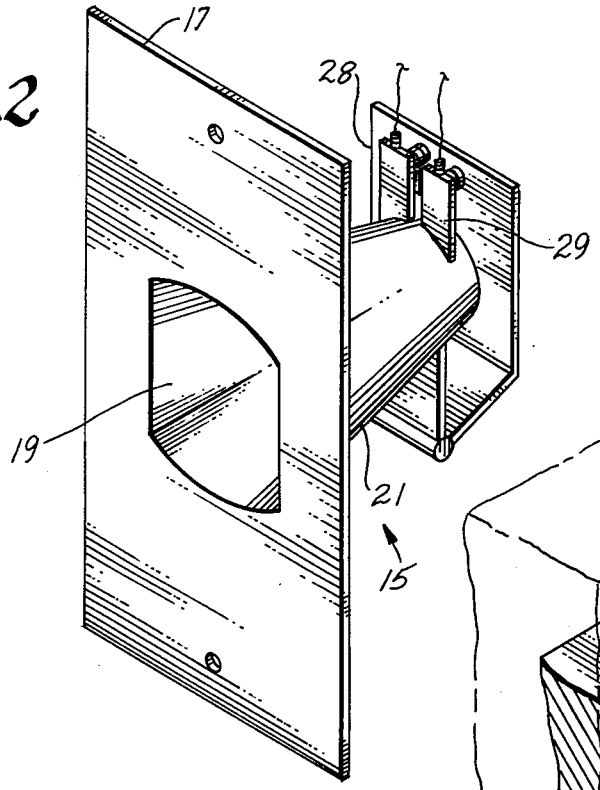
FIG. 2 is a perspective view showing separately an assembly that is installed in a building wall as indicated by FIG. 1.
Figure 5:
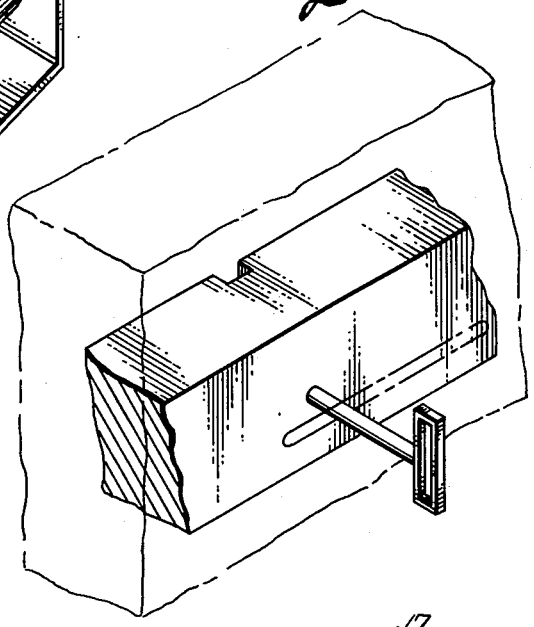
FIG. 5 is a perspective view schematically showing a portion of the closure shown in FIG. 1, but viewed from the inside of the building.
Figure 4:
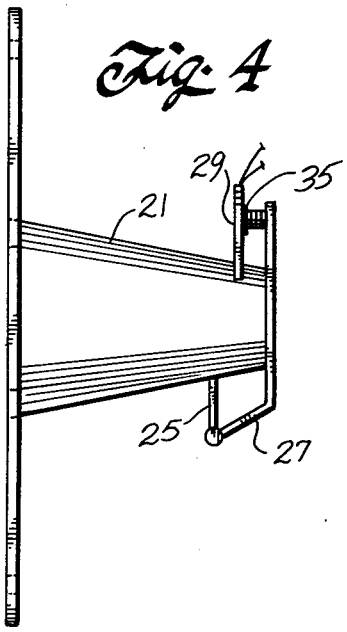
FIG. 4 is a side elevation view of the assembly of FIG. 2.
Figure 3:
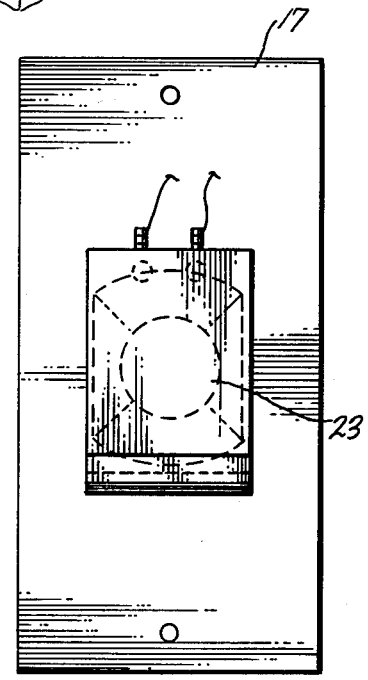
FIG. 3 is a rear elevation view of the assembly of FIG. 2.

An electrical switch is defined by certain members of assembly 15. In particular, a pair of upright, spaced-apart electrically conductive tabs 28 and 29 are supported by tubular portion 21 and each has a terminal post to which a respective one of wires 31 and 33 can be connected. An electrically conductive bridging member 35 affixed to plate 27 is provided to complete a series circuit path when plate 27 is oriented as shown in FIG. 2. When, on the other hand, plate 27 leans against the end of bore 13, wires 31 and 33 are electrically isolated from each other. As shown in FIG. 1, wires 31 and 33 are connected to a conventional air conditioning control circuit 36 such as the thermostat responsive circuitry that automatically controls the turning on and off of the air conditioner. With the electrical switch being open, air conditioning control circuit 36 keeps the air conditioner off.

In order to close the electrical switch to enable the air conditioner to operate, it is necessary for deadbolt 11 to be in its locking position. Deadbolt 11 has a magnet 37 at its end that attracts plate 27 such that plate 27 is oriented to close the electrical switch. With few exceptions such as magnet 37, a portion of plate 27 that is attracted thereto, and the electrical contact portions of the switch, the materials used for the preferred embodiment are plastic or non-magnetic metal.

According to a key feature of the invention, there is provided means, accessible only from the inside of the building while the door is closed, for shifting deadbolt 11 in either direction between its extreme positions. In the presently preferred embodiment, an elongated horizontally extending slot 40 is defined in door panel 3. An arm 41 is attached at one of its ends to deadbolt 11, and has a handle 42 defined at its opposite end. By gripping handle 41, a person within the building can move deadbolt 11 in either direction. While the door is closed, the above-described means for moving deadbolt 11 is accessible only from inside the building. Whenever a person leaves the building through this door, he can do so only by having the deadbolt in its unlocking position, whereby no power can be consumed by the air conditioner. After he leaves the building and closes the door, he no longer has access to enable him to move deadbolt 11 into its locking position.

A particularly advantageous preferred feature of the invention resides in an additional manually controllable means for moving deadbolt 11 to its unlocking position. As shown in FIG. 1, a T-shaped slot 45 is defined in door panel 3. A vertically extending notch 47 is defined in deadbolt 11 at a position that registers with one end of slot 45 when deadbolt 11 is in its locking position. A key 49 can be inserted into notch 47 in this condition and be used to move deadbolt 11 into its unlocking position. On the other hand, when deadbolt 11 is in its unlocking position, notch 47 is out of registration, and key 49 can not be so used. To foil any possible attempt to thwart the system, a horizontally extending notch 51 is defined in deadbolt 11. It will be appreciated that some device such as a pin or the like that will fit through the horizontally extending portion of slot 45 will have no face to act against to move deadbolt 11 to the right.

It will be appreciated that the above-described specific example of the invention has a broad range of application in various types of buildings including hotels, motels, apartment buildings, and the like. It is suitable for use in conserving energy, whether the source thereof is an electric utility company as is normally the case for air conditioners or otherwise as for example a natural gas supply to a heating system. It will also be appreciated by those skilled in the art that various modifications to the specifically described example can be made without departing from the scope of this invention.

I claim:

1. A system for reducing wasted power consumption by power consuming equipment used in a building having an openable closure through which access into and out of the building can be gained with the closure being opened, the system comprising:

lock means adapted to be installed in the closure, the lock means including a movable member movable in one direction to a locking position and movable in another direction to an unlocking position, the lock means further including engaging means positioned to be engaged with the movable member while the movable member occupies its locking position with the closure closed and to be disengaged from the movable member while the movable member occupies its unlocking position;

sensing means responsive to the movable member being out of its locking position for disabling the power consuming equipment;

first controllable means projecting from the closure so as to be accessible only from the inside of the building while the closure is closed, for manually shifting the movable member in either direction between its locking and unlocking position; and second controllable means, accessible from the outside of the building, for manually shifting the movable member only from its locking position to its unlocking position.

2. The system of claim 1, wherein the movable member comprises a deadbolt.

3. The system of claim 1, wherein the sensing means includes means defining an electrical switch.

4. The system of claim 3, wherein the sensing means includes magnetic means for controlling the electrical switch.

5. The system of claim 1, wherein the engaging means includes a tubular member having a partition positioned to conceal the sensing means from view.

* * * * *